US007997862B2

(12) United States Patent
Li

(10) Patent No.: US 7,997,862 B2
(45) Date of Patent: Aug. 16, 2011

(54) COOLING FAN

(75) Inventor: Ying-Liang Li, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 577 days.

(21) Appl. No.: 12/202,396

(22) Filed: Sep. 1, 2008

(65) Prior Publication Data

US 2009/0257869 A1 Oct. 15, 2009

(30) Foreign Application Priority Data

Apr. 9, 2008 (CN) ..... 2008 1 0066295

(51) Int. Cl.
*F03D 11/04* (2006.01)

(52) U.S. Cl. ..... 415/211.2

(58) Field of Classification Search ..... 415/211.2
See application file for complete search history.

(56) References Cited

U.S. PATENT DOCUMENTS

| | | | | |
|---|---|---|---|---|
| 6,386,276 | B1 | 5/2002 | Chen et al. | |
| 6,799,942 | B1 | 10/2004 | Tzeng et al. | |
| 7,184,268 | B2 | 2/2007 | Espinoza-Ibarra et al. | |
| 7,234,919 | B2 * | 6/2007 | Lee et al. | 415/208.2 |
| 7,275,910 | B2 * | 10/2007 | Chang et al. | 415/211.2 |
| 7,275,911 | B2 * | 10/2007 | Lee et al. | 415/211.2 |
| 7,726,939 | B2 * | 6/2010 | Lee et al. | 415/211.2 |
| 7,731,479 | B2 * | 6/2010 | Chang et al. | 415/191 |
| 7,824,154 | B2 * | 11/2010 | Yabuuchi | 415/211.2 |
| 2007/0065281 | A1 | 3/2007 | Lan et al. | |
| 2008/0219837 | A1 * | 9/2008 | Chang et al. | 415/182.1 |
| 2009/0226312 | A1 * | 9/2009 | Liu et al. | 415/211.2 |

FOREIGN PATENT DOCUMENTS

| | | |
|---|---|---|
| CN | 1746513 | 3/2006 |
| CN | 1779276 A | 5/2006 |

* cited by examiner

*Primary Examiner* — George Fourson, III

(74) *Attorney, Agent, or Firm* — Frank R. Niranjan

(57) ABSTRACT

A cooling fan includes a fan housing, a rotor and a stator. The fan housing forms an air inlet and an air outlet at two opposite sides thereof, respectively. A base is received in the fan housing and arranged at the air outlet of the fan housing. A guiding wall extends upwardly from an outer periphery of the base. An outer diameter of the guiding wall decreases along a direction from the air inlet to the air outlet. A plurality of stationary blades extend from an outer surface of the guiding wall to the fan housing. The stator is arranged in the housing and mounted on the base, and the rotor is rotatably supported by the stator.

14 Claims, 8 Drawing Sheets

COOLING FAN

BACKGROUND

1. Field of the Invention

The present invention relates to a cooling fan, and more particularly relates to a cooling fan having improved stationary blades.

2. Description of Related Art

With the continuing development of the electronic technology, electronic packages such as CPUs (central processing units) are generating more and more heat that requires immediate dissipation. Cooling fans are commonly used in combination with heat sinks for cooling CPUs.

Oftentimes, a cooling fan includes a stator and a rotor. The rotor includes a hub and a plurality of fan blades extending outwardly from the hub. A permanent magnet is arranged in the hub and surrounds the stator. The stator includes a stator core with coils winding therearound. When electrical currents are supplied to the coils, the rotor is pushed by magnetic force of the coils to rotate and thus the fan blades produce a forced airflow. A hollow frame is configured for supporting the rotor and the stator therein. A column-shaped supporting base is formed in a central of the frame, and a number of ribs interconnecting the supporting base and the frame. Unfortunately, when the forced airflow flows through the frame, turbulent flows will be generated after the airflow encounters the ribs so as to have an adverse effect on the blast pressure enhancement. Consequently, the efficiency of the fan is reduced.

For the foregoing reasons, therefore, there is a need in the art for a new cooling fan which overcomes the above-mentioned problems.

SUMMARY

According to an exemplary embodiment of the present invention, a cooling fan includes a fan housing, a rotor and a stator. The fan housing forms an air inlet and an air outlet at two opposite sides thereof, respectively. A base is received in the fan housing and arranged at the air outlet of the fan housing. A guiding wall extends upwardly from an outer periphery of the base. An outer diameter of the guiding wall decreases along a direction from the air inlet to the air outlet. A plurality of stationary blades extend radially and outwardly from an outer surface of the guiding wall to the fan housing. The stator is received in the fan housing and mounted on the base, and the rotor is rotatably supported by the stator.

Other advantages and novel features of the present invention will be drawn from the following detailed description of the exemplary embodiments of the present invention with attached drawings.

DETAILED DESCRIPTION OF THE EMBODIMENTS

Figure 1:
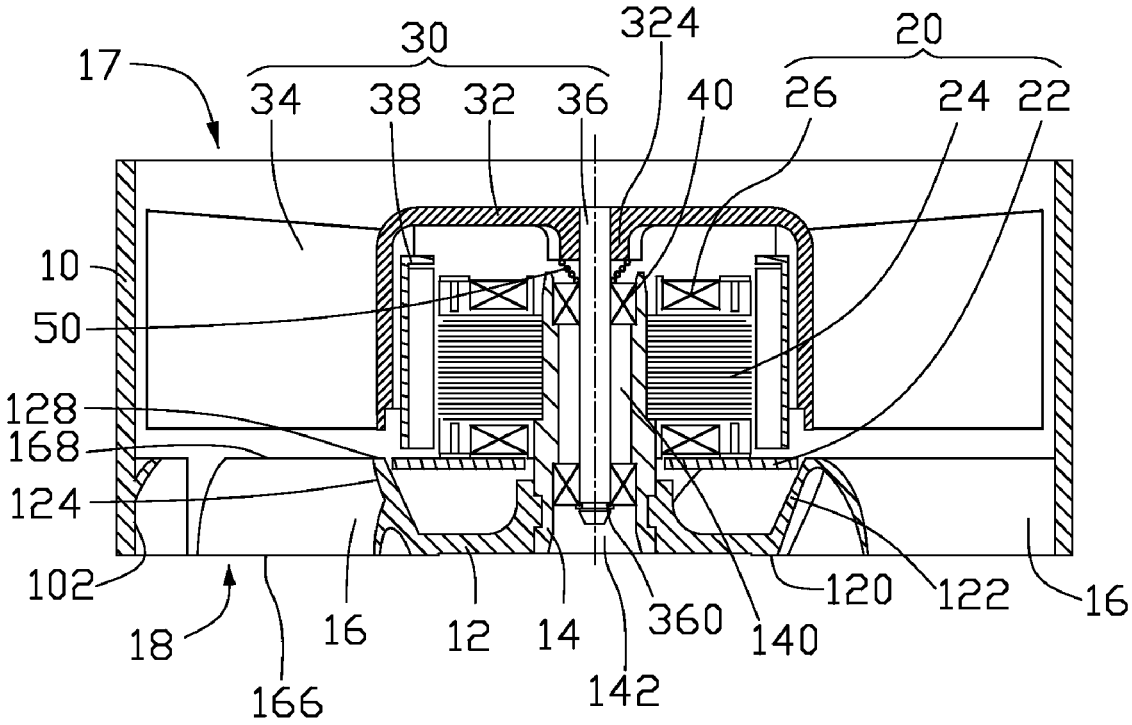
FIG. 1 is a cross sectional view of a cooing fan according to an exemplary embodiment of the present invention.
Figure 2:
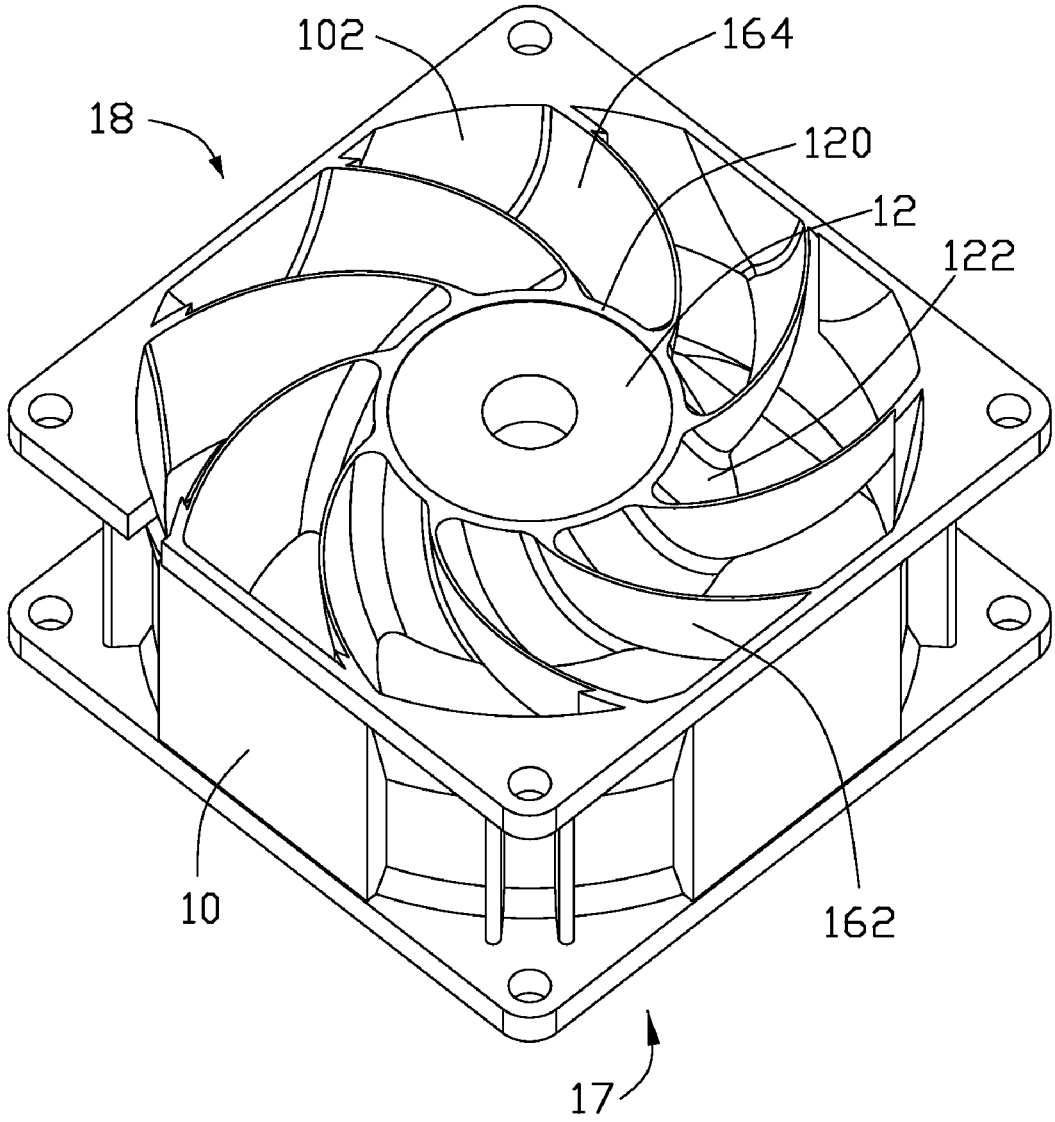
FIG. 2 is an isometric view of the cooling fan of FIG. 1, viewed from a bottom aspect thereof.

Referring to FIGS. 1 and 2, a cooling fan according to an exemplary embodiment includes a fan housing 10, a pair of bearings 40, a rotor 30 for generating a forced airflow, and a stator 20 in respective to which the rotor 30 is rotatable.

The fan housing 10 is square-shaped and hollow. A top side of the fan housing 10 forms an air inlet 17 for the forced airflow flowing into the fan housing 10, and a bottom side of the fan housing 10 forms an air outlet 18 of the cooling fan for the forced airflow flowing out the fan housing 10. A base 12 is received in the fan housing 10 and arranged at the air outlet 18 of the cooling fan. The base 12 is substantially circular shaped. A central tube 14 extends upwardly from a center of the base 12. A central hole 140 extends through the central tube 14, and thus top and bottom ends of the central tube 14 are open. An annular recess 142 communicating with the central hole 140 is formed in an inner circumference of each of the top and bottom ends of the central tube 14. Each recess 142 has a diameter larger than that of the central hole 140. Thus the top and bottom ends of the central tube 14 have an inner diameter larger than that of the other portion of the central tube 14.

A guiding wall 122 extends upwardly and outwardly from an outer periphery of the base 12. In this embodiment, the guiding wall 122 has a shape of an inverted frustum. A cross section of the guiding wall 122 is approximately trapezoid. An outer diameter of the guiding wall 122 is linearly decreased along the flowing direction of the forced airflow from the air inlet 17 to the air outlet 18. A plurality of stationary blades 16 extend radially and outwardly from the guiding wall 122 to the fan housing 10. The stationary blades 16 are inclined to the flowing direction of the forced airflow. Each stationary blade 16 has a curved shape and is thin, and includes a windward surface 162 faces to the forced airflow and an opposite leeward surface 164. An inner end of each stationary blade 16 connects to an outer surface 124 of the guiding wall 122, and an outer end of each stationary blade 16 connects to an inner surface 102 of the housing 10. A top side 168 of each stationary blade 16 is approximately horizontally, and is approximately coplanar with a top side 128 of the guiding wall 122. A bottom side 166 of each stationary blade 16 is approximately horizontally, and is approximately coplanar with a bottom side 120 of the guiding wall 122 and the bottom side of the fan housing 10.

The stator 20 is mounted around the central tube 14. The stator 20 includes a stator core 24 with coils 26 wound thereon to establish an alternating magnetic field, and a PCB 22 (printed circuit board) with electronic components mounted thereon. The electronic components are electrically connected with the coils 26 to control electrical current flowing through the coils 26. The rotor 30 includes a hub 32 forming a shaft seat 324 at a central portion thereof, a plurality of rotary blades 34 extending radially and outwardly from an outer periphery of the hub 32, a magnet 38 adhered to an inner surface 102 of the hub 32 and confronting the coils 26 of the stator 20, and a shaft 36 extending downwardly from the shaft seat 324 of the rotor 30.

The ball bearings 40 are received in the top and bottom recesses 142 of the central tube 14, respectively. An outer diameter of the bearings 40 is substantially the same as the diameter of the recesses 142 of the central tube 14, and an inner diameter of the bearings 40 is approximately the same as a diameter of the shaft 36. After assembled, the shaft 36 of the rotor 30 extends through the ball bearings 40, and thus is rotatably supported by the ball bearings 40. A locking ring 360 is engaged into a bottom end of the shaft 36 to limit movement of the shaft 36 along an axial direction thereof. A top end of the ball bearing 40 received in the top recess 142 of the central tube 14 is lower than the top end of the central tube 14. A conical-shaped coil spring 50 is arranged between the top ball bearing 40 and the hub 32 for providing a cushion between the top ball bearing 40 and the hub 32, thus preventing the hub 32 from severely colliding with the top ball bearing 40 during operation of the cooling fan. A bottom end of the spring 50 abutting against the ball bearing 40 has a diameter relatively smaller than that of a top end of the spring 50 abutting against the hub 32.

During operation, the rotor 30 is driven to rotate by the interaction of the alternating magnetic field established by the stator 20 and the magnetic field of the magnet 38 of the rotor 30. The rotary blades 34 thus produce the forced airflow. When the forced airflow flows from the air inlet 17 to the air outlet 18, it was guided by the stationary blades 16 to be expelled out of the cooling fan. As the stationary blades 16 are curved and thin, the stationary blades 16 guide the forced airflow to flow along the windward surfaces 162 and finally flow out the fan housing 10. Turbulent flows of the related cooling fan generated by the encountering of the forced airflow and the ribs are avoided. Furthermore, as the guiding wall 122 has a configuration of an inverted frustum, the outer diameter of the guiding wall 122 decreases along the flowing direction of the forced airflow, and thus an area of a cross section of a passage defined between the guiding wall 122 and the fan housing 10 for flowing of the airflow therethrough increases along the flowing direction of the airflow. A separation between the forced airflow and the windward surfaces of the stationary blades of column-shaped base is avoided. Turbulence flows can be avoided from forming on the windward surfaces 162 of the stationary blades 16 near the air outlet 18. Since the turbulence flows which reduce the pressure of the forced airflow are avoided, the efficiency of the cooling fan is improved.

Figure 3:
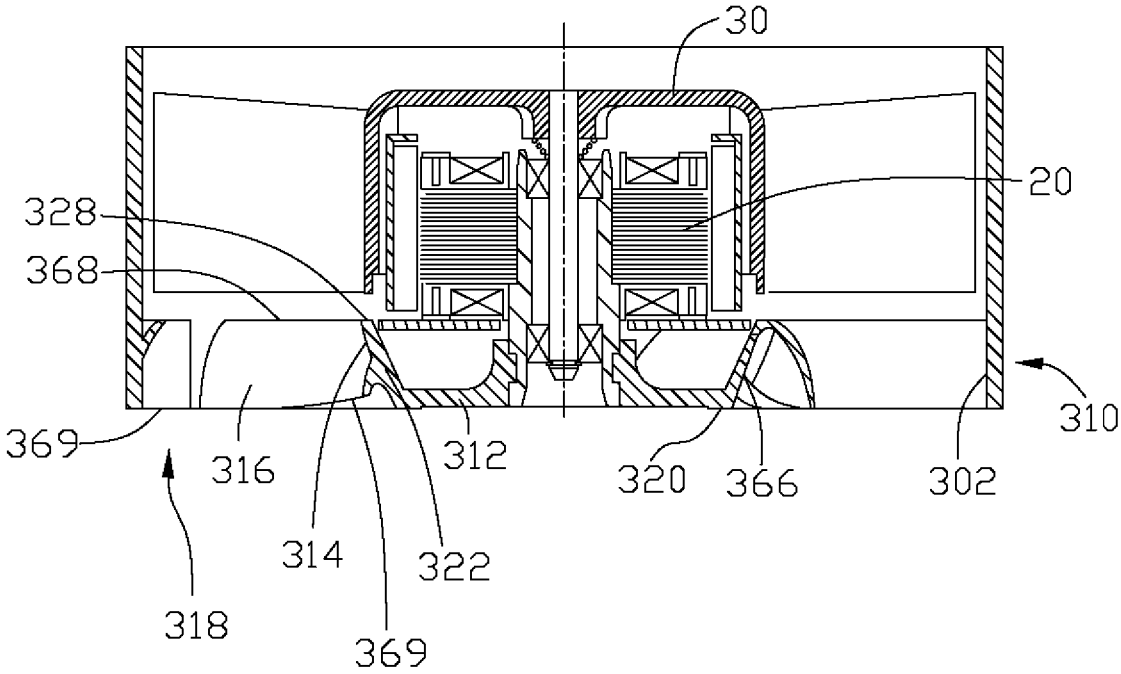
FIG. 3 is a cross sectional view of an alternative embodiment of the cooling fan.
Figure 4:
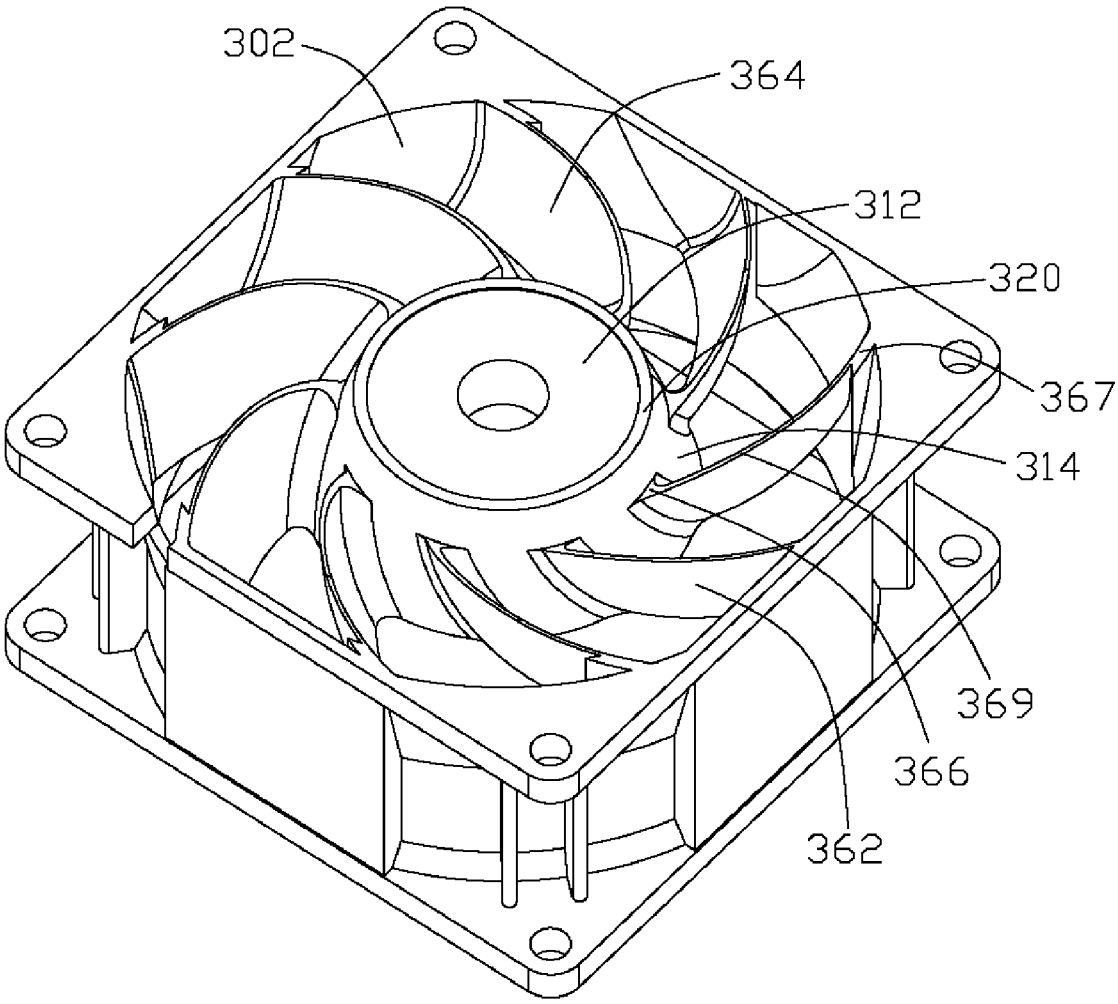
FIG. 4 is an isometric view of the cooling fan of FIG. 3, viewed from a bottom aspect thereof.

FIGS. 3-4 show an alternative embodiment of the cooling fan. The cooling fan includes a fan housing 310, a base 312 arranged in an air outlet 318 of the fan housing 310 for supporting the rotor 30 and the stator 20 thereon. A guiding wall 322 extends upwardly and outwardly from the base 312. An outer diameter of the guiding wall 322 gradually decreases along the following direction of the forced airflow. A plurality of stationary blades 316 extend from an outer surface 314 of the guiding wall 322 to an inner surface 302 of the fan housing 310. Each stationary blade 316 includes a windward surface 362 and an opposite leeward surface 364. The difference between this embodiment and the first embodiment is that a height of each stationary blade 316 increases along the outwardly extending direction of the stationary blade 316. A top side 368 of each stationary blade 316 is approximately horizontally, and is approximately coplanar with a top side 328 of the guiding wall 322. A bottom side 369 of each stationary blade 316 is convex. An inner end 366 of the bottom side 369 of the stationary blade 316 connected to the guiding wall 322 is higher than a bottom side 320 of the guiding wall 322, and an outer end 367 of the bottom side 369 of the stationary blade 316 connected to the inner surface 302 of the fan housing 310 is approximately at the same level as a bottom side 320 of the guiding wall 322 and a bottom side of the fan housing 310.

Figure 5:
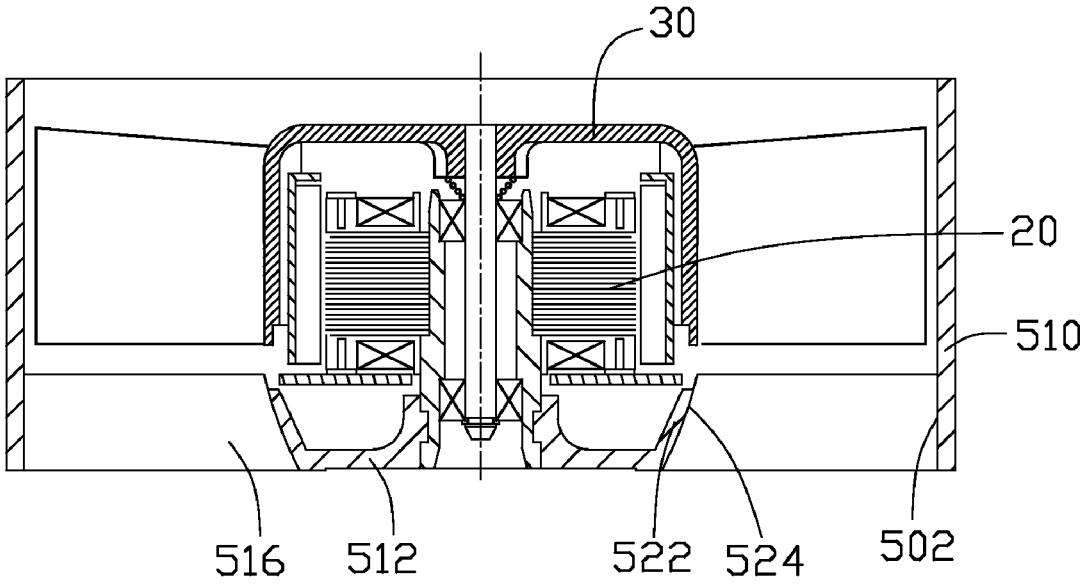
FIG. 5 is a cross sectional view of a third embodiment of the cooling fan.
Figure 6:
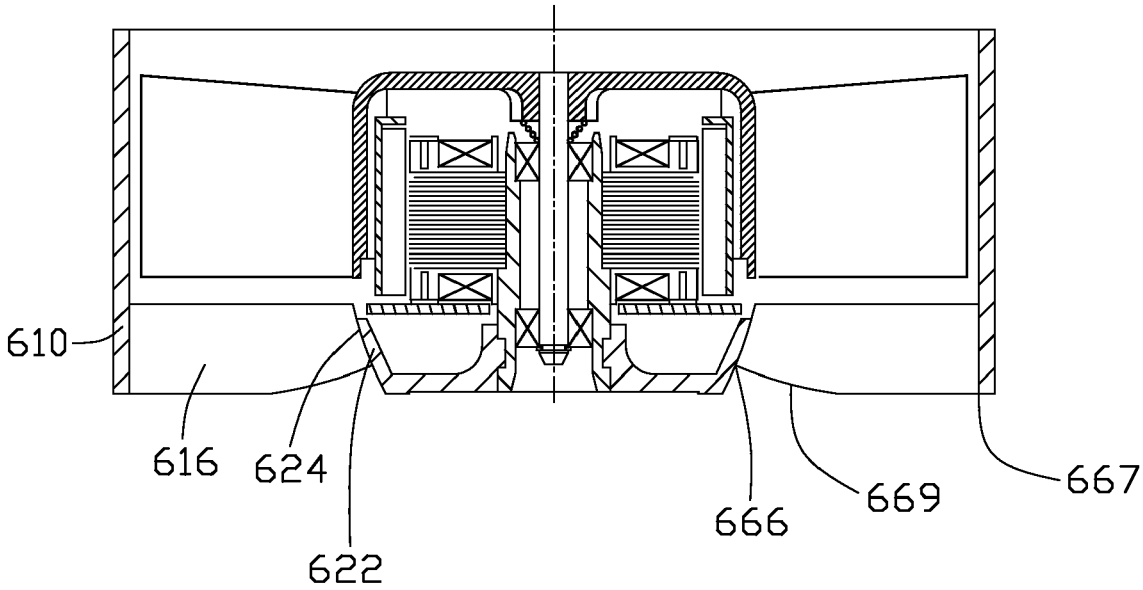
FIG. 6 is a cross sectional view of a fourth embodiment of the cooling fan.

FIG. 5 shows a cross sectional view of the cooling fan according to a third embodiment. The cooling fan also includes a fan housing 510, a base 512 arranged in the fan housing 510 for supporting the stator 20 and the rotor 30 thereon, a guiding wall 522 extending upwardly from the base 512, and a plurality of stationary blades 516 interconnecting an outer surface 524 of the guiding wall 522 and an inner surface 502 of the fan housing 510. The difference between this embodiment and the first embodiment is that the outer surface 524 of the guiding wall 522 is conicoid. A generatrix of the outer surface 524 is quadratic curve. Alternatively, the guiding wall 522 can be other shapes, such as cone, streamline, or arc. FIG. 6 shows a fourth embodiment of the cooling fan which has a guiding wall 622 being the same as that of the third embodiment, i.e., an outer surface 624 of the guiding wall 622 is conicoid. The difference between the fourth embodiment and the third embodiment is that a plurality of stationary blades 616 interconnect the guiding wall 622 and the fan housing 610 being convex. A height of each stationary blade 616 increases from the guiding wall 622 to the fan housing 610. An inner end 666 of a bottom side 669 of each stationary blade 616 is higher than an outer end 667 of the bottom side 669 of the stationary blade 616.

Figure 7:
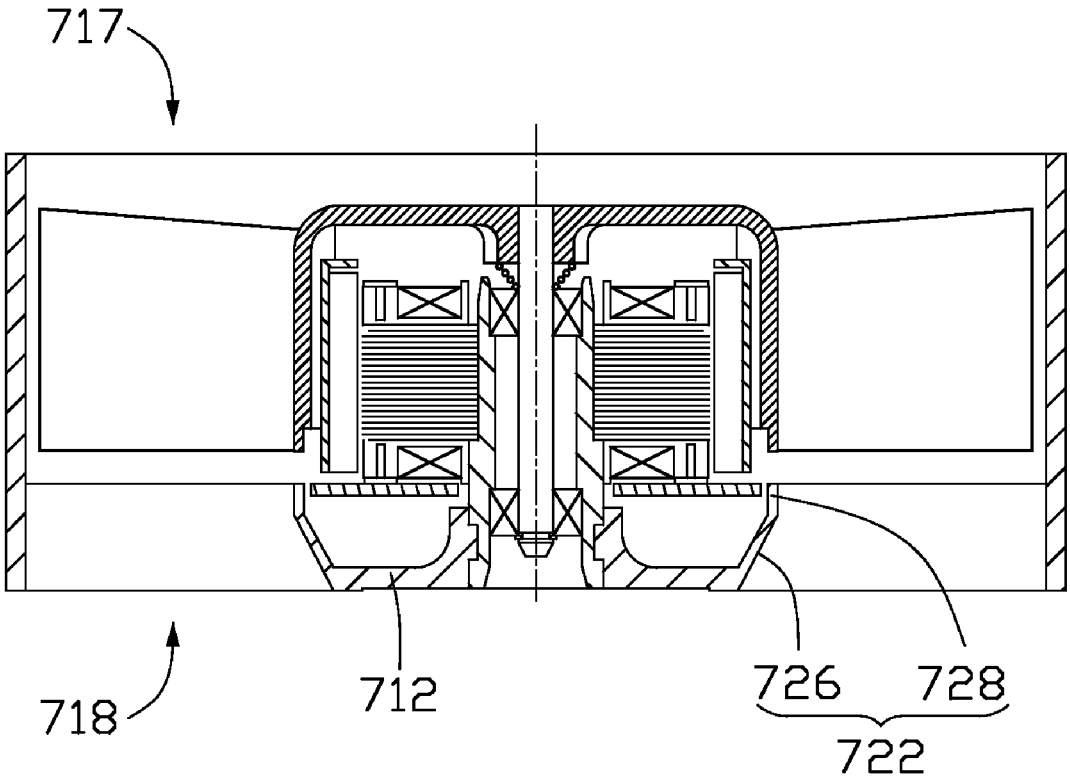
FIG. 7 is a cross sectional view of a fifth embodiment of the cooling fan.

As shown in FIG. 7, a cooling fan according to a fifth embodiment has a guiding wall 722 being different from that of the previous embodiments. In this embodiment, the guiding wall 722 includes a lower portion 726 and an upper portion 728. The lower portion 726 extends outwardly and upwardly from an outer periphery of a base 712, and has a shape of an inverted frustum with an outer diameter gradually decreasing along a flowing direction of the forced airflow from an air inlet 717 to the air outlet 718. The upper portion 728 extends upwardly from the lower portion 726, and has a shape of a cylinder which has a constant diameter along the flowing direction of the forced airflow.

Figure 8:
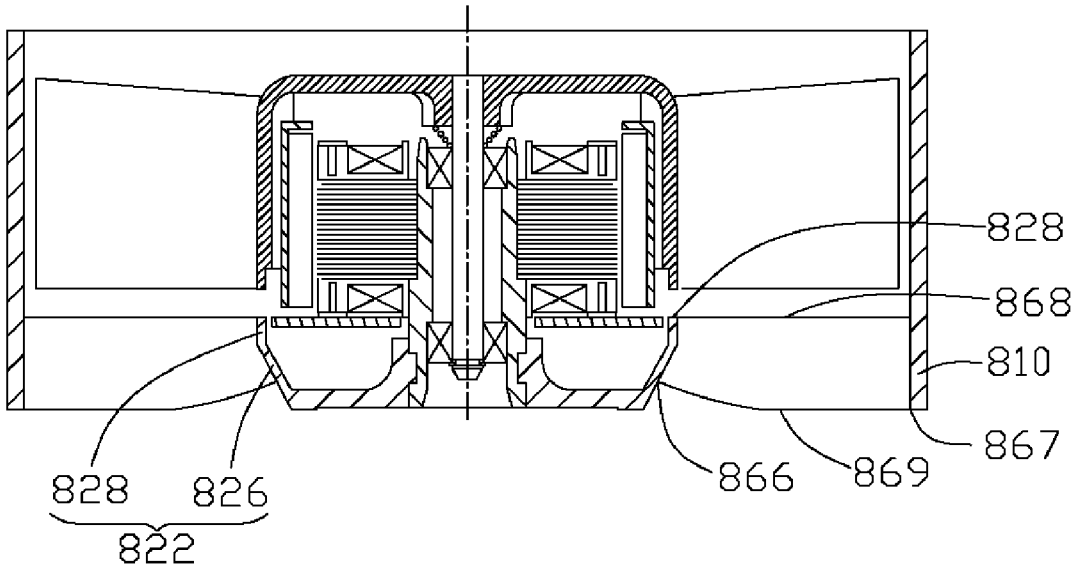
FIG. 8 is a cross sectional view of a sixth embodiment of the cooling fan.

FIG. 8 shows a sixth embodiment of the cooling fan which has a guiding wall 822 being the same as that of the fifth embodiment. The difference between this embodiment and the fifth embodiment is that the stationary blades 816 are substantially the same as the fourth embodiment. The guiding wall 822 includes a lower portion 826 having a shape of an inverted frustum and an upper portion 828 being cylinder shaped. The stationary blades 816 are convex. A height of each stationary blade 816 increases from the guiding wall 822 to the fan housing 810. An inner end 866 of a bottom side 869 of each stationary blade 816 is higher than an outer end 867 of the bottom side 869 of the stationary blade 816. A top side 868 of each stationary blade 816 is approximately horizontal, and is approximately coplanar with a top side 828 of the guiding wall 822.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A cooling fan, comprising:

a fan housing forming an air inlet and an air outlet at two opposite sides thereof, respectively;

a base being received in the fan housing and arranged at the air outlet of the fan housing;

a guiding wall surrounding the base and having an outer surface with a diameter decreasing along a direction from the air inlet to the air outlet;

a plurality of stationary blades extending from the outer surface of the guiding wall to the housing;

a stator being arranged in the housing and mounted on the base ; and a rotor being rotatably supported by the stator.

2. The cooling fan of claim 1, wherein the guiding wall has a configuration of an inverted frustum, the diameter of the outer surface of the guiding wall linearly decreasing from the air inlet to the air outlet.

3. The cooling fan of claim 1, wherein the outer surface of the guiding wall is streamline.

4. The cooling fan of claim 1, wherein the outer surface of the guiding wall is arc-shaped.

5. The cooling fan of claim 1, wherein the outer surface of the guiding wall is conicoid, and a generatrix of the outer surface is quadratic curve.

6. The cooling fan of claim 1, wherein the guiding wall comprises an upper portion and a lower portion, the upper portion being cylinder-shaped, a diameter of the outer surface of the upper portion being approximately constant, a diameter of the outer surface of the lower portion gradually decreasing from the air inlet to the air outlet.

7. The cooling fan of claim 1, wherein each stationary blade has a height increasing from the guiding wall to the fan housing.

8. The cooling fan of claim 7, wherein a bottom end of the stationary blade at the guiding wall is higher than a bottom of the guiding wall.

9. A fan housing, comprising:

a hollow housing forming an air inlet and an air outlet at two opposite sides thereof, respectively;

a base being received in the housing and arranged at the air outlet of the housing;

a guiding wall extending upwardly from an outer periphery of the base, a diameter of an outer surface of the guiding wall decreasing along a direction from the air inlet to the air outlet; and a plurality of stationary blades extending from the outer surface of the guiding wall to the housing.

10. The fan housing of claim 9, wherein the guiding wall has a shape of an inverted frustum, the diameter of the outer surface of the guiding wall linearly decreasing from the air inlet to the air outlet.

11. The fan housing of claim 9, wherein the outer surface of the guiding wall has one of the following shapes: streamline, arc-shaped, and conicoid.

12. The fan housing of claim 9, wherein the guiding wall comprises an upper portion and a lower portion, the upper portion being cylinder-shaped, a diameter of the outer surface of the upper portion being approximately constant, a diameter of the outer surface of the lower portion gradually decreasing from the air inlet to the air outlet.

13. The fan housing of claim 9, wherein each stationary blade has a height increasing from the guiding wall to the fan housing.

14. The fan housing of claim 13, wherein a bottom end of the stationary blade at the guiding wall is higher than a bottom of the guiding wall.

* * * * *